US008936133B2

(12) United States Patent
Esmond

(10) Patent No.: US 8,936,133 B2
(45) Date of Patent: Jan. 20, 2015

(54) FOUR CYCLE INTERNAL COMBUSTION ENGINE EXHAUST

(76) Inventor: Greg Scott Esmond, McKinney, TX (US)

( * ) Notice: Subject to any disclaimer, the term of this patent is extended or adjusted under 35 U.S.C. 154(b) by 264 days.

(21) Appl. No.: 13/409,942

(22) Filed: Mar. 1, 2012

(65) Prior Publication Data

US 2013/0230434 A1 Sep. 5, 2013

(51) Int. Cl.
*F01N 1/10* (2006.01)

(52) U.S. Cl.
USPC ..... 181/252; 181/212; 181/255; 181/227; 181/228; 181/247

(58) Field of Classification Search
USPC ..... 181/252, 212, 255, 227, 228, 247, 249, 181/250, 266, 276
See application file for complete search history.

(56) References Cited

U.S. PATENT DOCUMENTS

| | | | | |
|---|---|---|---|---|
| 4,116,303 | A * | 9/1978 | Trudell | 181/252 |
| 4,371,054 | A * | 2/1983 | Wirt | 181/252 |
| 5,198,625 | A * | 3/1993 | Borla | 181/248 |
| 7,549,510 | B2 * | 6/2009 | Sakurai et al. | 181/252 |
| 7,552,797 | B2 * | 6/2009 | Luttig | 181/250 |
| 7,624,842 | B2 * | 12/2009 | Mizutani | 181/249 |
| 8,602,157 | B2 * | 12/2013 | Luttig et al. | 181/227 |
| 8,640,821 | B2 * | 2/2014 | Matsushima et al. | 181/252 |
| 2005/0230182 | A1 * | 10/2005 | Nezan et al. | 181/250 |
| 2006/0243521 | A1 * | 11/2006 | Price | 181/248 |
| 2009/0000282 | A1 * | 1/2009 | Gruber | 60/299 |
| 2009/0000862 | A1 * | 1/2009 | Buell et al. | 181/212 |
| 2009/0065296 | A1 * | 3/2009 | Chang et al. | 181/255 |
| 2009/0236174 | A1 * | 9/2009 | Horie | 181/249 |
| 2010/0282538 | A1 * | 11/2010 | Kim et al. | 181/269 |

FOREIGN PATENT DOCUMENTS

JP 04081507 A * 3/1992 ..... F01N 1/08

* cited by examiner

*Primary Examiner* — Forrest M. Phillips

(57) ABSTRACT

Exhaust apparatus for four cycle (including Wankel) internal combustion engines is disclosed. The apparatus is configured to manage pressure waves created by expanding gas emitted from the engine combustion chambers, the net result being to enhance engine performance and attenuate noise over a wide range of engine RPMs.

33 Claims, 12 Drawing Sheets

FOUR CYCLE INTERNAL COMBUSTION ENGINE EXHAUST

TECHNICAL FIELD

The invention relates to four cycle internal combustion engines. More particularly, the invention relates to exhaust apparatus for enhancing the performance of associated engines. In preferred embodiments, the invention relates to energy conservation and the more efficient utilization of energy resources.

BACKGROUND

In internal combustion gasoline engines, reflected pressure waves ("compression waves") are generated in the exhaust system, which are caused by catalytic converters, resonators, mufflers or changes in cross-sectional area of exhaust piping. These reflected pressure waves in the exhaust system adversely impact torque output over a range of engine speeds or RPMs (revolutions per minute). The impact from these pressure waves is greater with modern engine technologies with variable valve timing and/or lift wherein valve lift and duration is increased at higher engine speeds. Pressure waves typically reflect off the exhaust system and back toward the engine, sometimes resonating, and often creating zones of alternating high and low pressure waves. These pressure waves vary according to engine RPM, tuning, and other factors, resulting in optimum torque at a given engine speed, but impaired torque at higher or lower than optimum engine speeds.

Much effort has been expended devising ways to improve engine performance. Patents have been granted for engine tuning devices and aftermarket modifications to stock exhaust systems. For example, U.S. Pat. No. 5,050,378 to Clemmons describes an expansion chamber (divergent/convergent cone) for four cycle internal combustion engines. However, the Clemmons apparatus is beneficial only for engines that employ some additional mechanism to briefly and partially reopen the engine's exhaust valve(s) after the intake valves have effectively closed. This reflected pressure wave increases cylinder pressure immediately before combustion. However, in the absence of an auxiliary reopening of the exhaust valves as taught by Clemmons, i.e., in conventional four cycle engines, there is no benefit from reflected compression waves within the exhaust system.

Another example of efforts to improve exhaust apparatus, U.S. Pat. No. 6,840,037 to Oberhardt, discloses an exhaust pulse control device with a simple expansion chamber, described as resulting in increased engine torque over a range of RPMs. Oberhardt does not address the impact and/or contribution of pressure wave management in the catalytic converter. Another potential problem not addressed by Oberhardt is its use of exceedingly steep transition angles. In addition, Oberhardt neglects the need to manage the reflected pressure waves created by the convergent end of the expansion chamber, and makes no mention of providing for sound attenuation.

Due to these and other problems and potential problems, there is a need for improved four cycle internal combustion engine exhaust apparatus designed and constructed to achieve pressure wave management that increases engine torque over a wide range of engine RPM levels, preferably also integrating with emissions control devices. Accordingly, the invented four cycle internal combustion engine exhaust embodiments described herein would be useful and advantageous contributions to the arts.

SUMMARY OF THE INVENTION

In carrying out the principles of the present invention, in accordance with preferred embodiments, the invention provides advances in the arts with novel apparatus directed to improved efficiency an enhanced engine performance of four cycle internal combustion engines. In preferred embodiments, gains in engine performance may be accompanied by sound attenuation.

According to aspects of the invention, examples of preferred embodiments include exhaust apparatus for four cycle internal combustion engines having means for receiving exhaust upon its egress from an engine, including a divergent cone and a first chamber in fluid communication with the divergent cone. A catalytic converter is interposed between and in fluid communication with the first chamber and a second chamber. A convergent cone then routes the exhaust from the second chamber to an outlet. The configuration is such that the beneficial effects pressure waves within the exhaust are employed for improving performance while the negative effect of the pressure waves are reduced.

According to aspects of the invention, examples of preferred embodiments also include sound deadening material integrated with one or more internal surface of the apparatus.

According to aspects of the invention, examples of preferred embodiments include exhaust apparatus for four cycle internal combustion engines also including anti-reversion vanes integrated with one or more internal surface.

According to aspects of the invention, examples of preferred embodiments include exhaust apparatus configured to be approximately one quarter of the total length of the exhaust path from the inlet to the outlet.

According to another aspect of the invention, preferred embodiments of include exhaust apparatus configured to be approximately one half of the total length of the exhaust path from the inlet to the outlet.

According to another aspect of the invention, preferred embodiments of exhaust apparatus for four cycle internal combustion engines also adapted to attenuate the resonant frequency of the exhaust.

According to another aspect of the invention, preferred embodiments additionally include at least one branch attenuator in a configuration adapted to attenuate the resonant frequency of the exhaust.

The invention has advantages including but not limited to one or more of, improved power output from engines used in association with the invention, sound attenuation, and reduced costs. These and other potential advantageous, features, and benefits of the present invention can be understood by one skilled in the arts upon careful consideration of the detailed description of representative embodiments of the invention in connection with the accompanying drawings.

BRIEF DESCRIPTION OF THE DRAWINGS

The present invention will be more clearly understood from consideration of the following detailed description and drawings in which.

Figure 1:
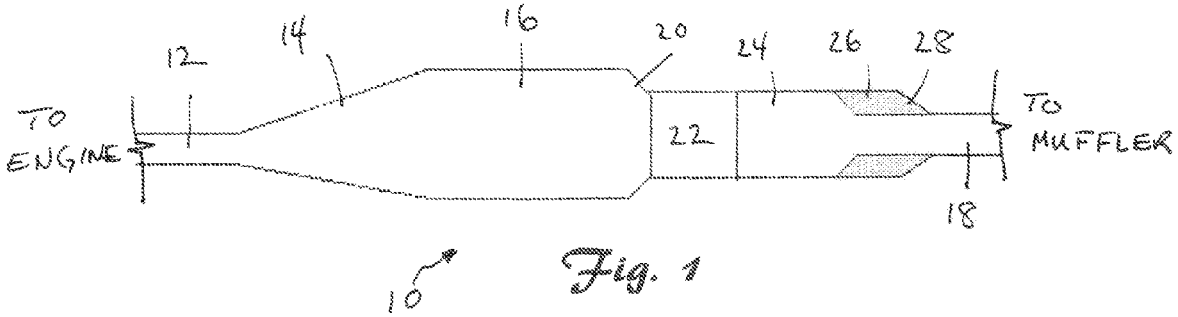
FIG. 1 shows a longitudinal sectional view of an example of a preferred embodiment of apparatus of the invention.

References in the detailed description correspond to like references in the various drawings unless otherwise noted. Descriptive and directional terms used in the written description such as right, left, back, top, bottom, upper, side, et cetera, refer to the drawings themselves as laid out on the paper and not to physical limitations of the invention unless specifically noted. The drawings are not to scale, and some features of embodiments shown and discussed are simplified or amplified for illustrating principles and features as well as advantages of the invention.

DESCRIPTION OF PREFERRED EMBODIMENTS

The inventor has devised novel and useful improvements to internal combustion engine exhausts. The invention may be practiced with four cycle internal combustion engines in their various forms and sizes, including but not limited to, engines ranging from two to twelve cylinders, Wankel rotary engine designs, and gasoline, diesel, or natural gas fueled engines in general. The operation of the four cycle internal combustion engine exhaust apparatus of the invention is described in the context of an automobile engine as an example herein. The principles of the invention may also be practiced in other applications such as marine engines, stationary generators, heavy equipment, aircraft, and motorcycles, for example. The operation, principles, and various features of the invention are first described, followed by further description of examples of presently preferred embodiments.

It has been determined that when the exhaust valve(s) of a four cycle engine first opens immediately after combustion has occurred, a powerful positive pressure wave ("compression wave") begins traveling down the exhaust system at sonic speed. When this pressure wave encounters a change in exhaust pipe diameter, a portion of the pressure wave energy is reflected back upstream toward the engine. In the event the pressure wave encounters an increase in pipe diameter, the reflected wave has a negative pressure ("rarefaction wave"). In the event the pressure wave encounters a reduction in pipe diameter, the reflected wave has a positive pressure ("reflected compression wave"). The reflected positive and negative pressure waves both can have a significant impact on engine output depending on when they arrive back to the engine. In the event a reflected pressure wave arrives back to a closed exhaust valve, it is reflected back downstream. In the event a reflected pressure wave arrives back at an open exhaust valve, a negative pressure wave increases engine output, but a positive pressure wave reduces output.

A negative pressure wave reflected back to an open exhaust valve increases engine output by helping to extract exhaust from the cylinder ("scavenge"), which in turn increases the quantity of fresh air that can be drawn in through the intake valve. In the case of the negative pressure wave arriving after the intake valve has begun to open, the negative pressure wave passes through the cylinder, and draws even more intake air into the cylinder. Inversely, a positive pressure wave that arrives back to an open exhaust valve pushes exhaust back into the cylinder, which decreases the quantity of fresh air that can be drawn in through the intake valve. A positive pressure wave that arrives back at the exhaust valve after the intake valve has begun to open continues through the cylinder to the intake manifold, which reduces the intake of air to the cylinder.

Manufacturers typically attempt to tune their engine control modules to work around the inherent reflected positive pressure waves to deliver the best overall performance, balanced against emission reduction goals. However, performance enthusiasts often replace manufacturer-supplied exhaust systems with aftermarket exhaust systems in order to improve engine output. The same performance enthusiasts often also replace or alter the engine control module to disable monitoring of the catalytic converter and further improve engine output by optimizing fuel, ignition, and/or valve timing to take advantage of the new exhaust system.

It has been determined that the most significant positive reflection of the exhaust pressure wave is generally caused by the catalytic converter, since the catalytic converter is typically located at or near the very front of the exhaust system. Since the catalyst within the catalytic converter is a porous "brick" with small holes to allow the exhaust gases to pass through, there is a very large reflection of the pressure wave. The location of the catalytic converter determines the engine speed at which output is reduced the most. Because of this, performance enthusiasts often gut or remove the catalytic converter completely, and replace it with "test pipes", which provides a significant increase in engine output. In many instances, such modifications result in non-compliance with emission-control goals.

After extensive research and development, it has been determined that if the catalytic converter is located further downstream in the exhaust system, within an expansion chamber, engine output can be greatly improved even beyond that obtained by completely removing the catalytic converter. This is achieved by placing a divergent cone in the exhaust pipe so that it provides the first change in diameter that the pressure wave encounters. As the pressure wave passes through the divergent cone, a significant amount of its wave energy is reflected back toward the engine as a negative pressure wave, which helps evacuate (scavenge) the cylinder. Optionally, the divergent cone may also include anti-reversion barriers and/or sound deadening material to absorb/dampen the positive pressure wave that continues downstream.

In this configuration, the catalytic converter is positioned downstream from the divergent cone, and optional sound deadening material, if any. Thus, when the positive pressure wave reaches the catalytic converter, its energy has already been reduced significantly by the divergent cone (and sound deadening material). The catalytic converter nevertheless reflects a positive pressure wave back toward the engine, but that reflected positive pressure wave is further reduced by the sound deadening material as it passes back into the divergent cone. Furthermore, as the reflected pressure wave enters the divergent cone (now convergent with respect to the back-reflected pressure wave), the reduction in diameter causes another reflection of the pressure wave, downstream toward the catalytic converter. The net result is that the ratio of reflected negative pressure compared to reflected positive pressure is much larger (i.e., more favorable) at the engine, and engine output is significantly increased.

It should be appreciated by those skilled in the art that, depending on target engine speeds and valve timing and duration, the location of the expansion chamber may be optimized within the principles of the invention so that the negative pressure waves arrive back to the engine at times that multiple cylinders have open exhaust valves. In this case, a positive pressure wave that exits one cylinder can cause negative pressure waves that help evacuate (scavenge) multiple cylinders (itself and the next cylinder in the firing order). Such an implementation can significantly improve engine output within the targeted engine speed range.

In addition to the performance benefits described, the apparatus including an expansion chamber with integrated catalytic converter may preferably also be adapted to attenuate undesirable sound frequencies commonly present in exhaust systems. Every pipe system has acoustic properties that determine which sound frequencies have high or low levels of attenuation. The frequency where attenuation is at its minimum is called the resonant frequency. In a constant diameter pipe, resonant frequency can be calculated as c/l, where c is the speed of sound and l is the length of the pipe. For example, if the speed of sound is approximately 1300 feet per second, then a 10 foot constant diameter exhaust pipe would resonate at 130 Hz. Since a four cylinder engine generates a 130 Hz exhaust pulse at an engine speed of 3850 rotations per minute (RPM), its exhaust sound level would be highest at 3850 RPMs if mated to that same 10 foot exhaust system. Furthermore, since automobiles with four cylinder engines often attain highway cruising speeds above 3500 RPMs, a 10 foot exhaust system often provides unpleasant sound levels at highway speeds.

In preferred embodiments of four cycle internal combustion engine exhaust systems, in order to increase attenuation of exhaust sound at the exhaust system's resonant frequency, the expansion chamber with integrated catalytic converter may be lengthened so that it serves a dual purpose as a quarter-wave resonator. Since maximum attenuation occurs when a sound wave passes through a pipe equal to ¼ its wavelength, the expansion chamber for the 10 foot constant diameter exhaust pipe described in the above example should be about 2.5 feet long (1300 fps/130 Hz=10 foot wavelength). Furthermore, the constant diameter pipe between the exhaust manifold and expansion chamber should be about 2.5 feet long, as should the constant diameter pipe between the expansion chamber and the muffler. Each 2.5 foot section provides significant attenuation of the 130 Hz exhaust frequency, and the net result is a sound level that is more consistent across all engine speeds. The example herein is provided for purposes of illustrating some of the features and advantages of the invention. It should be understood that the example should not be taken to limit the scope of the invention, and that the invention may be practiced with various engine and exhaust sizes and capacities.

An example of a preferred embodiment of four cycle internal combustion engine exhaust apparatus 10 is shown in FIG. 1. Exhaust inlet pipe 12 matches the diameter of the header output of an associated engine (not shown). The inlet 12 may be a fitting or joint, or may include a length of pipe, depending upon the space available in a given application. Additionally, it should be understood that the inlet, or other components described and shown may be straight or curved with respect to the longitudinal axis depending upon the space limitations of a particular application. A divergent cone 14 is the first transition piece as shown. The location of the divergent cone 14 is preferably selected based upon the anticipated normal operating speed of the engine, and the number of cylinders that feed the inlet pipe 12. In the case of a 4 cylinder engine with single exhaust pipe and a normal operating engine speed range between 3,000 and 8,000 RPMs, for example, the divergent cone 14 is preferably about 80 pipe-inches from the engine exhaust ports. However, this is also dependent on cam timing as well. The divergent cone 14 should be placed a sufficient distance from the exhaust ports, such that by the time the negative pressure pulse returns, the intake valves of the initiating cylinder have already begun to open, while the exhaust valves are still open. This allows the negative pressure wave to pass through the combustion chamber into the intake plenum, which helps pull air in through the intake duct. Furthermore, the exhaust valves of the next cylinder in the engine's firing order by this time have also begun to open. Hence, each cylinder receives a negative pressure wave at the beginning of the exhaust stroke (from the previous cylinder), then receives another negative pressure wave at the end of the exhaust stroke (from itself). The divergent cone 14 preferably has an angle within the range of about 5 to 90 degrees.

A first chamber 16 has as its primary purpose to contribute to the overall length from the inlet 12 to the outlet 18. The overall length of the from inlet to outlet is preferably about ¼ (for 4-cylinder, or ½ for V8 engines) of the total length of the exhaust apparatus from the header collector to the entrance to the muffler. In the prior art, the total length of the exhaust system often causes a natural resonant frequency that produces undesirable sound levels at normal engine speeds. By lengthening the first chamber 16 to a suitable length (e.g., ¼, or ½), the first chamber 16 provides significant attenuation at that frequency.

The convergent or reverse cone 20 has the primary purpose of offsetting any difference in diameter between the divergent cone 14 and the catalytic converter 22. This convergent cone 20 may be omitted completely if the outer diameter of the catalytic converter 22 matches the diameter the divergent cone 14 and first chamber 16.

Absent the invention, the catalytic converter 22 is typically located very close to the header collector in order to reduce the time required for the catalyst to "light off" (i.e., reach operating temperature). However, it has been determined that placing the catalytic converter close to the engine causes a powerful reflection of positive pressure back to the exhaust ports, which causes a significant reduction in power. By moving the catalytic converter 22 further downstream, aft of the divergent cone 14, the performance loss from the catalytic converter 22 becomes less significant. The catalytic converter 22 may be located closer to either end of the apparatus in order to balance the trade-off between engine performance and emissions performance without departing from the principles of the invention. If the catalytic converter 22 is too far away from the engine, it may not reach a high enough operating temperature to function. In some implementations, it may be preferable to cover the inner and/or outer surfaces of portions of the exhaust apparatus with a thermal barrier in order to increase the temperature within the catalytic converter 22.

The second chamber 24, located aft of the catalytic converter 22, has a function similar to that of the first chamber 16. Its length is determined according to the geometric considerations previously described.

Optional sound absorption material 26 varies in extent and shape. Some or all of the second chamber 24 may contain sound absorption material of a suitable type, e.g., glass fibers encased in perforated stainless steel, or the like. This helps attenuate noise, e.g., high pitched exhaust sounds (rasp).

Convergent or reverse cone 28 functions to terminate the second chamber 24 and adapt the diameter to that of the outlet 18 leading to the muffler(s). Exhaust outlet 18 matches the diameter of the muffler flange or other muffler hardware (not shown) downstream. The outlet 18 may include a length of pipe, depending upon placement of any muffler and/or tailpipe(s). The angle of the convergent cone 28 may be large or small as needed for fitment within the vehicle, but it has been found that higher angle cones tend to provide better attenuation of the exhaust system's resonant frequency. It has been determined that angles within the range of about 5 to 90 degrees are preferable.

Figure 2:
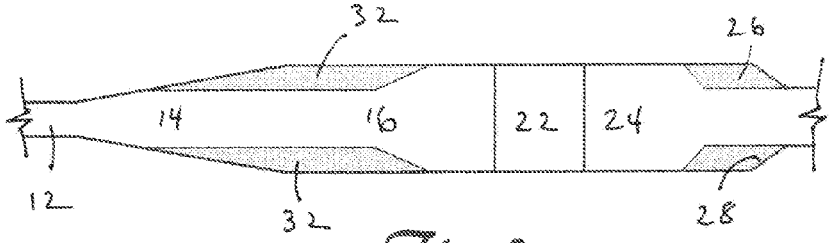
FIG. 2 shows a longitudinal sectional view of an alternative example of a preferred embodiment of apparatus of the invention showing optional sound-deadening material.

FIG. 2 shows a variation of a preferred embodiment of the invention 30 in which the outer diameters of the divergent cone 14 and first chamber 16 match that of the catalytic converter 22. It also illustrates the optional use of sound deadening material 32 within the divergent cone 14 and expansion chamber 16 for the purpose of reducing unwanted engine noise.

Figure 3:
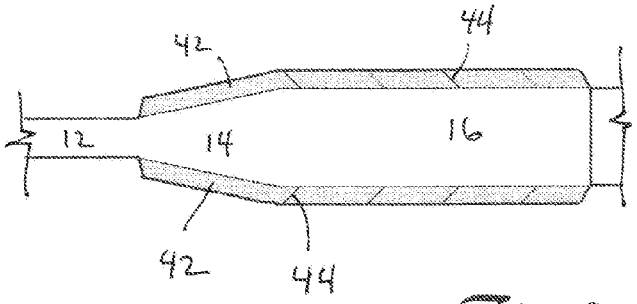
FIG. 3 is a close-up partial longitudinal sectional view of an example of a preferred embodiment of apparatus of the invention showing internal sound deadening material combined with anti-reversion barriers to reduce reflected pressure waves from the catalytic converter.

FIG. 3 shows another alternative embodiment of the invention 40 in which the divergent cone 14 and expansion chamber 16 include sound deadening material 42 and solid anti-reversion barriers 44 to further reduce reflected positive pressure waves from the catalytic converter (not shown). Preferably, the anti-reversion barriers 44 are stainless steel annuli integrated with the wall of the first chamber 16, although other shapes may also be used.

Figure 4:
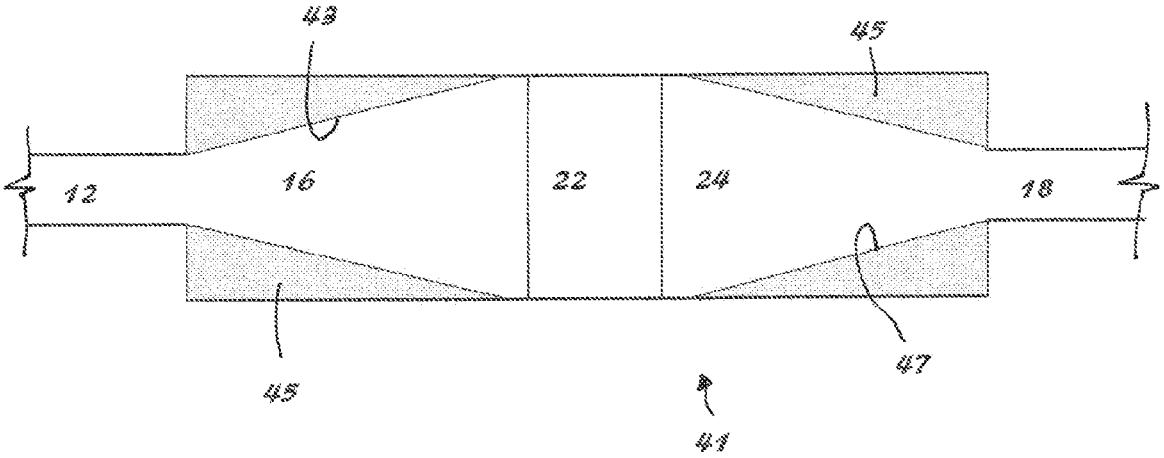
FIG. 4 is a longitudinal sectional view illustrating an alternative preferred embodiment of four cycle internal combustion engine exhaust apparatus incorporating internal divergent and convergent cones with a constant diameter external cross sectional shape.

FIG. 4 illustrates an alternative preferred embodiment of four cycle internal combustion engine exhaust apparatus 41 according to the invention. It can be seen that the external diameter of the apparatus 41 defined by the first chamber 16, catalytic converter 22, and second chamber 24, is more or less constant. Within the first chamber 16, a divergent cone 43 preferably includes perforations and is backed by sound deadening material 45. Similarly, a convergent cone 47 may include sound deadening material 45. Functionally, the operation of the apparatus 41 is as described above. It is believed that the apparatus 41 of FIG. 4 may provide advantages in terms of reduced manufacturing costs.

Figure 5:
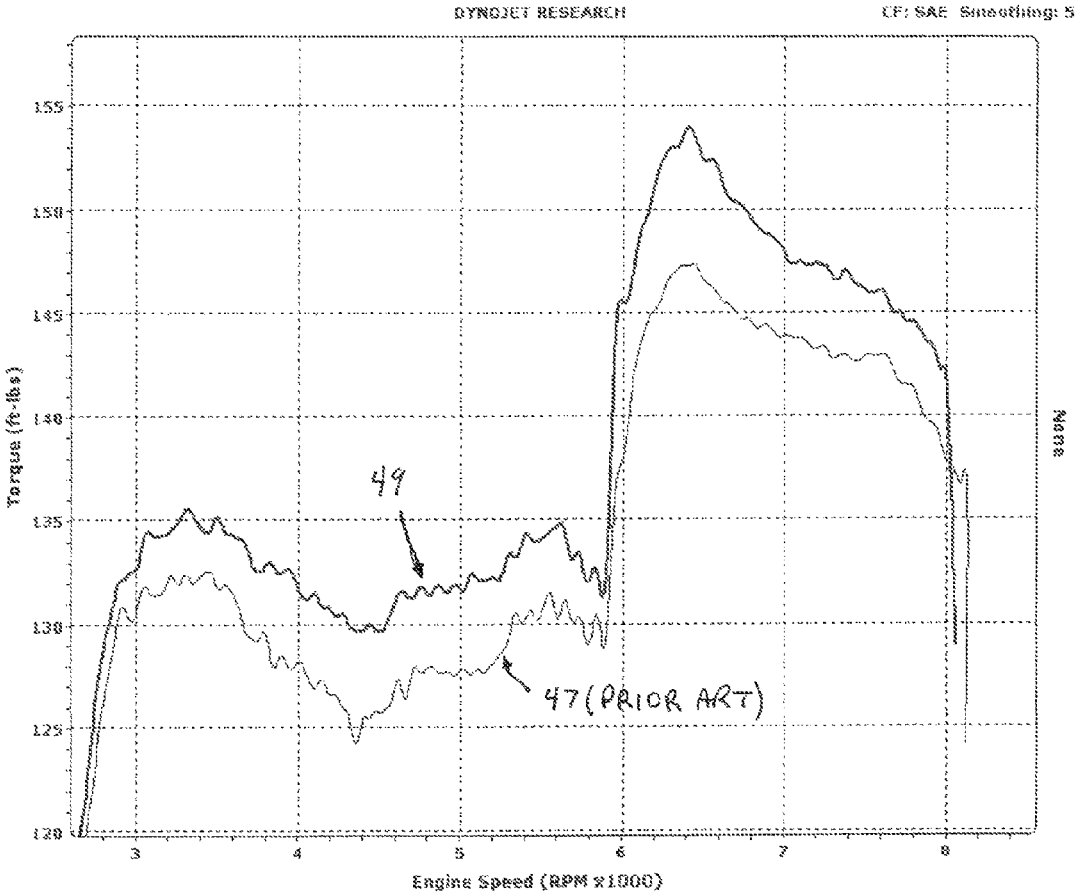
FIG. 5 is a graph of torque versus engine RPM, showing the response of a prior art exhaust compared to that of an exemplary embodiment of the exhaust apparatus of the invention.
Figure 6:
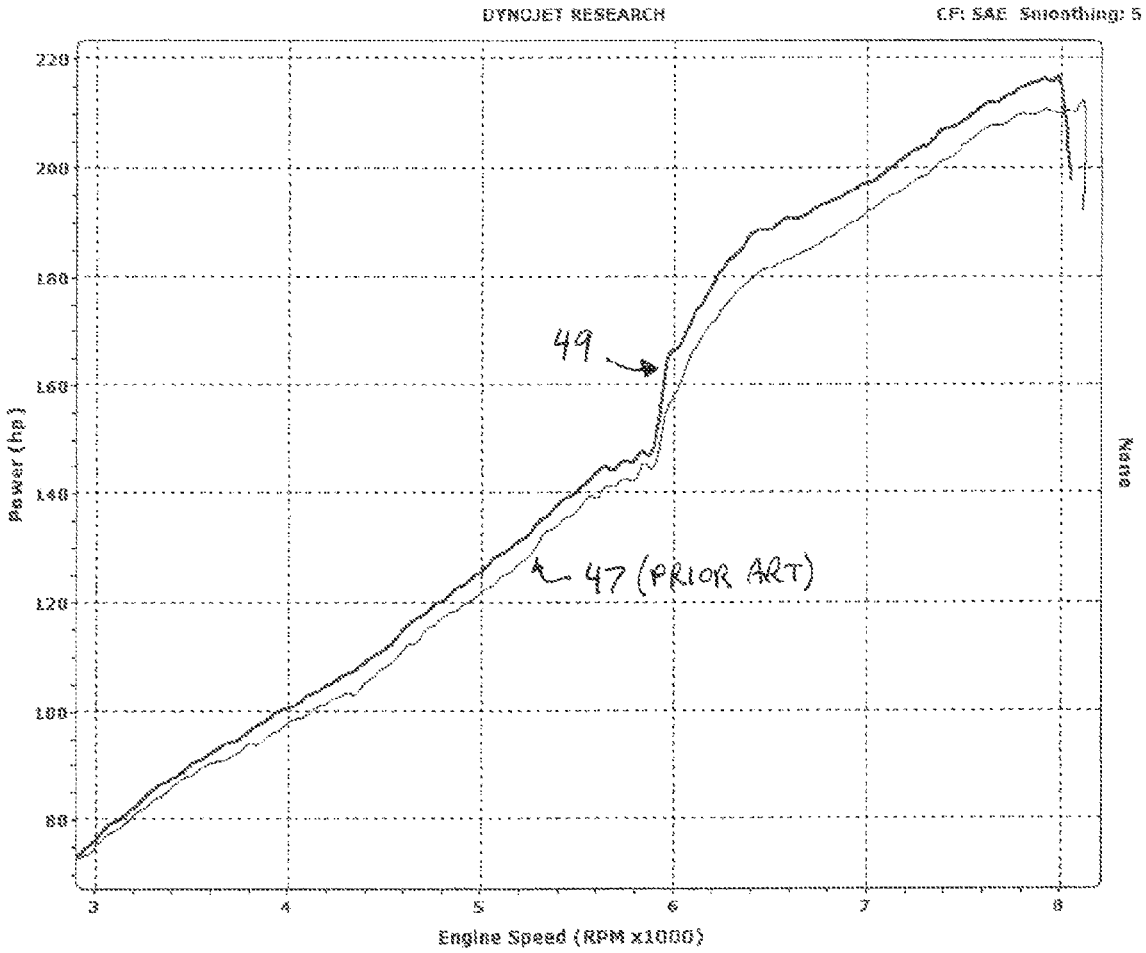
FIG. 6 is a graph of horsepower versus engine RPM, showing the response of a prior art exhaust compared to that of an exemplary embodiment of the exhaust apparatus of the invention.
Figure 7:
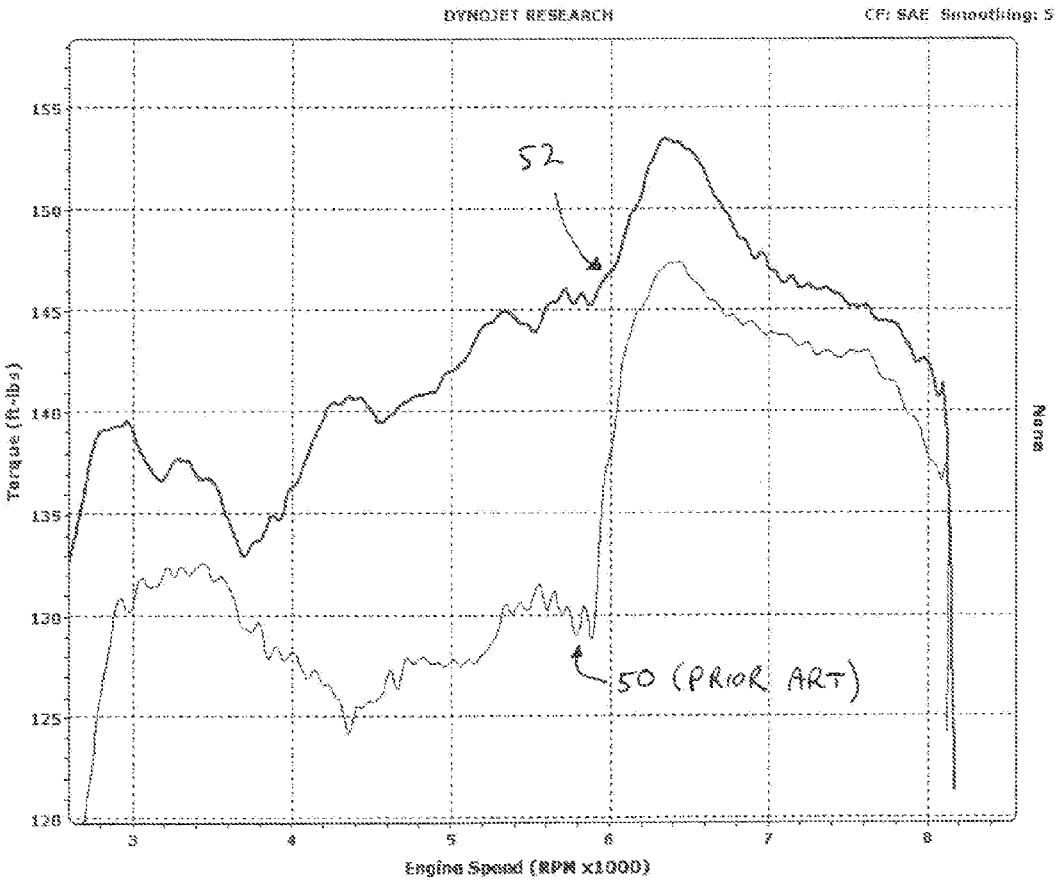
FIG. 7 is a graph of torque versus engine RPM, showing the response of a prior art exhaust compared to that of an exemplary embodiment of the exhaust apparatus of the invention.
Figure 8:
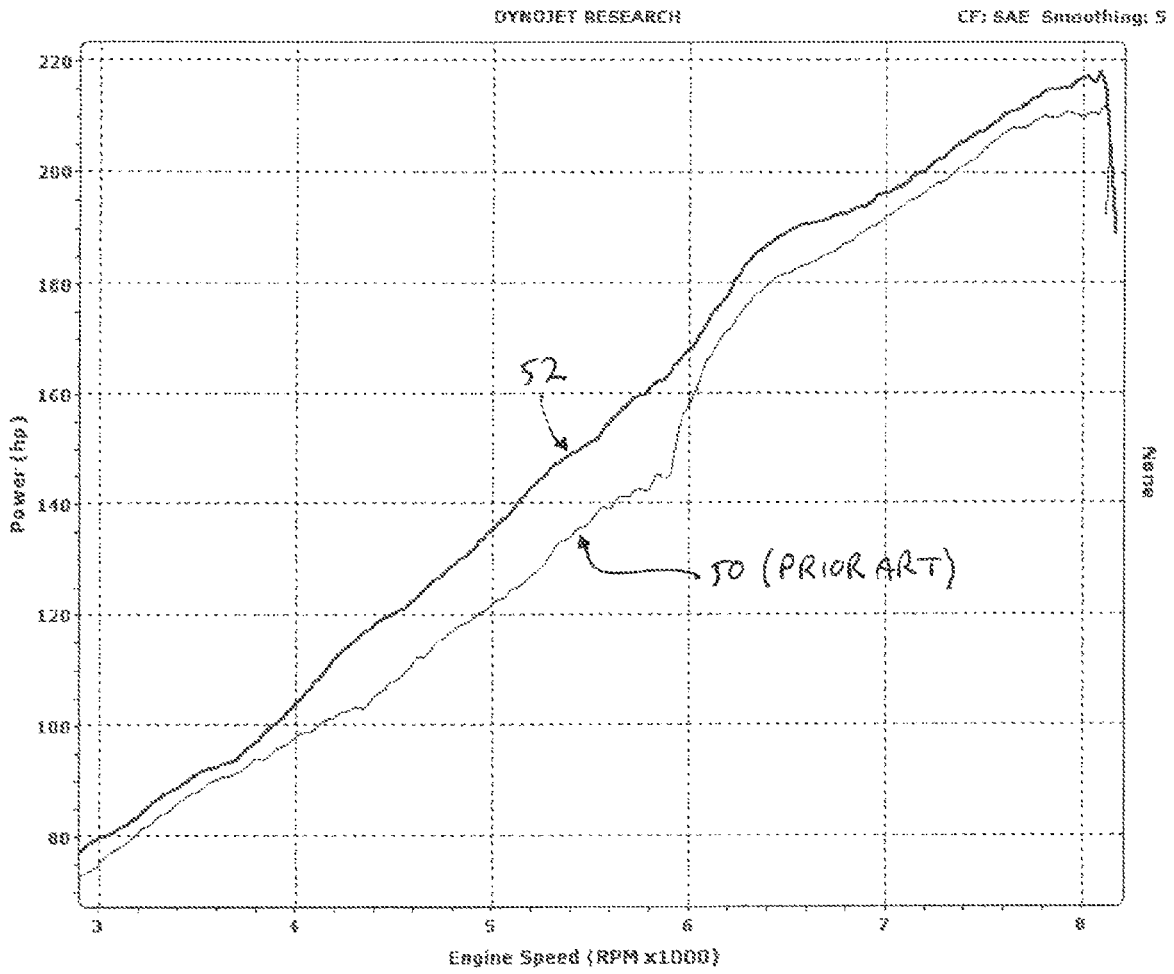
FIG. 8 is a graph of horsepower versus engine RPM, showing the response of a prior art exhaust compared to that of an exemplary embodiment of the exhaust apparatus of the invention.

FIG. 5 and FIG. 6 show graphical representations of an example of the increase in engine output that can be achieved by the invention. This exemplary embodiment was implemented using a 2008 Honda ("Honda" is a registered trademark of Honda Giken Kogyo Kabushiki Kaisha (Honda Motor Co. Ltd.) Corporation Japan 1-1, 2-Chome Minami-aoyama Minato-Ku Japan) S2000 model automobile, which is noted for several characteristics. First, at the time of its introduction, the Honda S2000 delivered the highest horsepower per liter of any production vehicle (over 120 HP per liter). Second, the S2000's motor only produced modest output below 6000 RPMs. Third, the S2000 exhaust system was purportedly optimized at the factory according to state-of-the-art exhaust tuning knowledge and technology. A baseline torque plot 47 was obtained using the factory exhaust system and factory engine computer with factory engine tune. The improved torque plot 49 was obtained using the four cycle internal combustion engine exhaust apparatus of the invention FIG. 7 and FIG. 8 show graphical representations of an example of the increase in engine output that can be achieved by the invention with intake and exhaust valve timing electronically altered in the engine computer to take advantage of the improved exhaust pressure management. The alteration of the engine computer was performed in order to engage the engine's VTEC system (two stage intake and exhaust valve system) at a lower RPM than would otherwise occur. From the factory, the S2000's VTEC system engages at 6000 RPMs, which is nearly optimal for the factory exhaust system. This is shown in the baseline plot 50. However, with the preferred embodiment of the exhaust apparatus of the present invention in this implementation, the optimal VTEC engagement RPM is approximately 3600 RPMs, as shown in plot 52.

Figure 9:
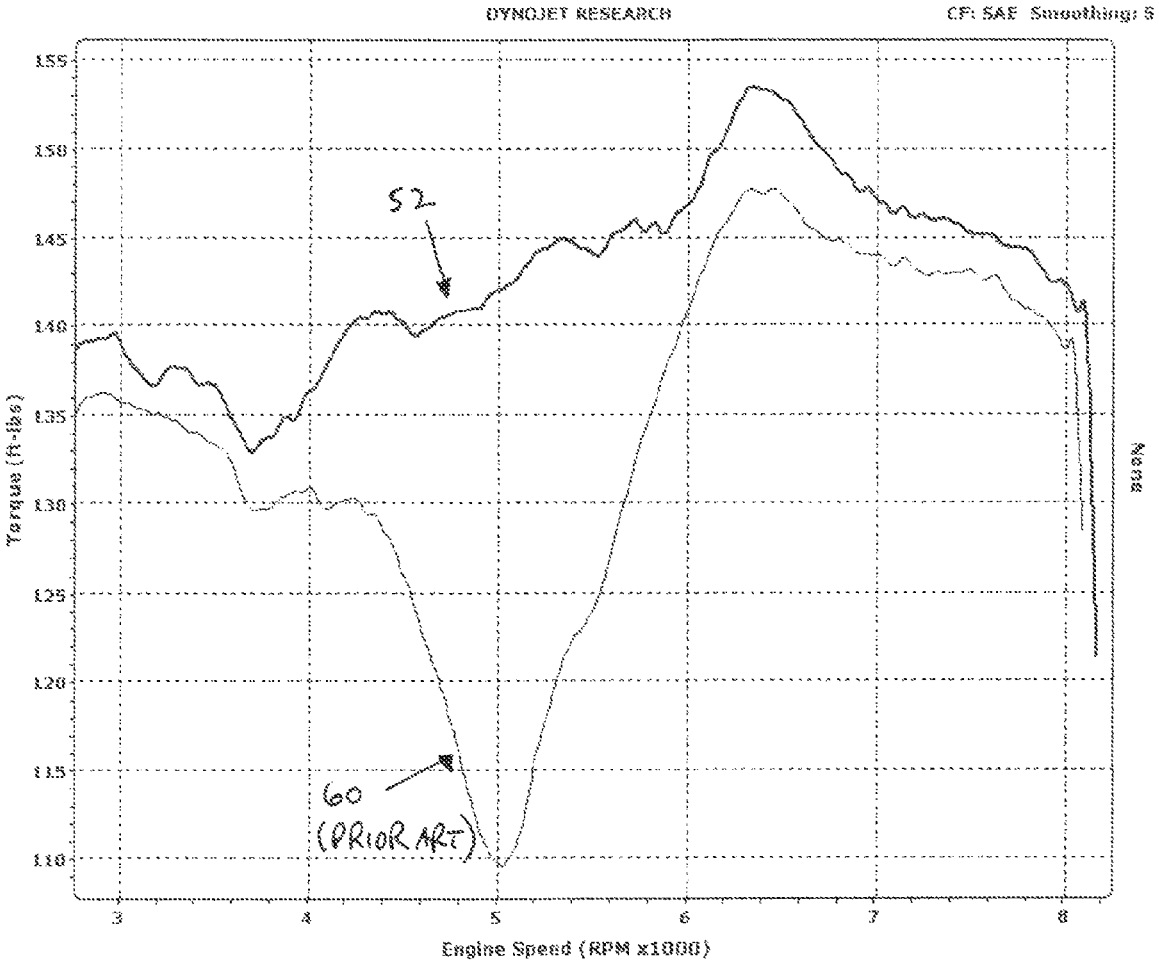
FIG. 9 is a graph of torque versus engine RPM, showing both the response of a prior art exhaust with special retuning compared to that of an exemplary embodiment of the exhaust apparatus of the invention.
Figure 10:
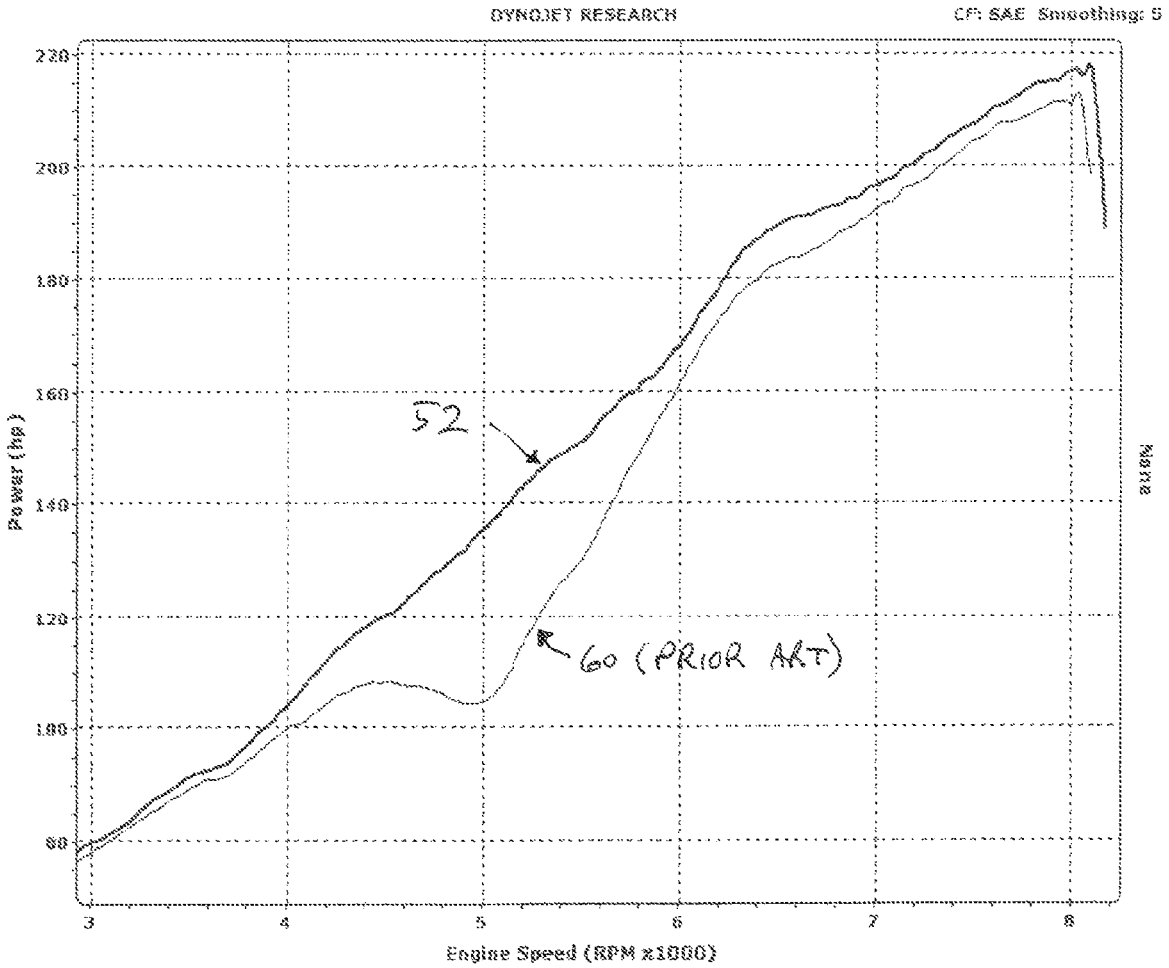
FIG. 10 is a graph of horsepower versus engine RPM, showing both the response of a prior art exhaust with special retuning compared to that of an exemplary embodiment of the exhaust apparatus of the invention.

For comparison purposes, FIG. 9 and FIG. 10 depict graphical representations of the performance of the factory exhaust system when using the same altered engine computer with VTEC engagement lowered to 3600 RPMs. It can be seen that the factory exhaust system generates such extreme reflected positive pressure waves 60 that engine output drops dramatically when VTEC is engaged below 5600 RPMs compared with the performance of the invention 52.

Figure 11:
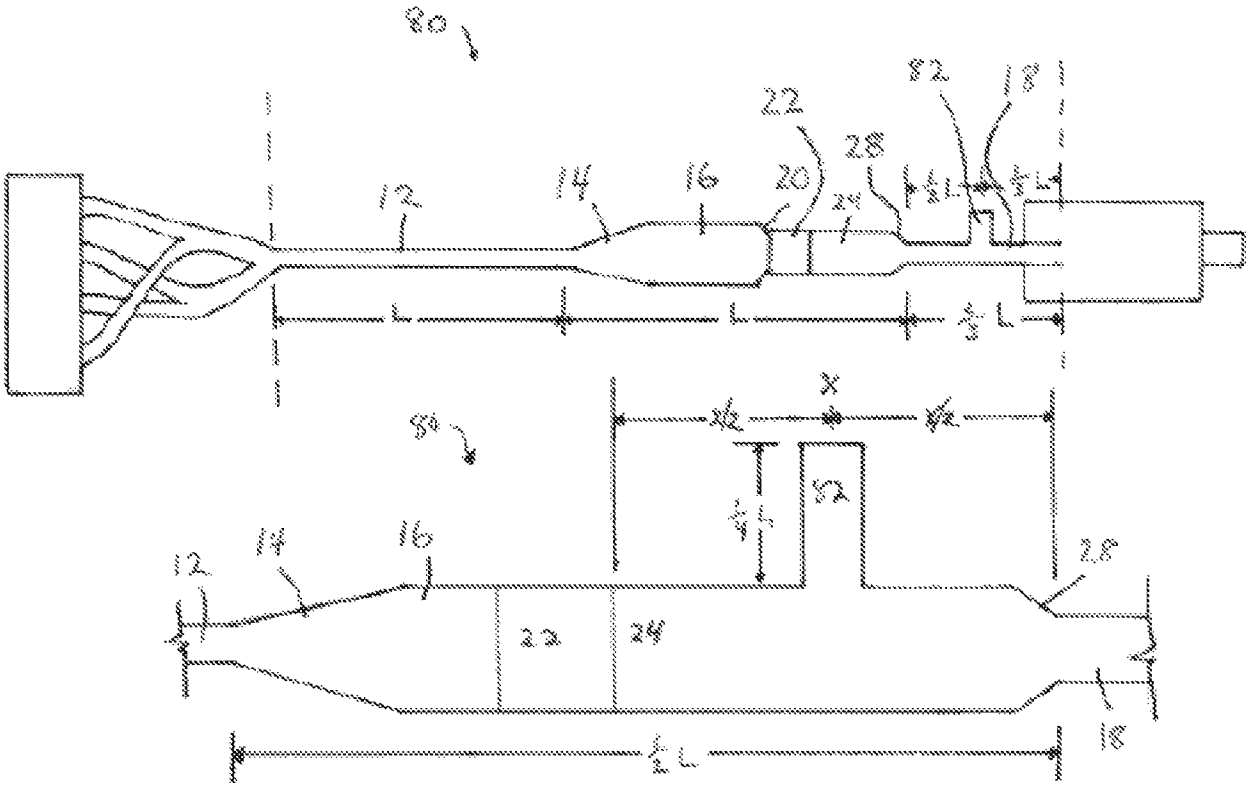
FIG. 11 is a longitudinal sectional view of an alternative example of a preferred embodiment of apparatus of the invention showing an optional branch attenuator.

The apparatus of the invention includes features for attenuating selected frequencies produced by an engine with which the invention is used. In an example of a preferred alternative embodiment of the invention illustrated in FIG. 11, a four cycle internal combustion engine exhaust 80 is shown in which a branch attenuator 82 is used to target a selected frequency for attenuation. For the purposes of illustration, assume that the length L is the quarter wavelength of the drone frequency selected for attenuation. Further assume that due to physical constraints, such as available space in a vehicle for example, the overall length of the exhaust apparatus as described in the above examples is constrained to a length shorter than L. A closed-ended branch attenuator 82 may be included as shown in order to attenuate the selected frequency. In presently preferred embodiments, the length of the branch attenuator 82 is one half of the distance that the overall apparatus is shorter than L, denoted (L−X). Locating the branch attenuator 82 having a length of X/2 in the middle of the exhaust section, or pipe, or second chamber 24 as shown in this example, provides a configuration in which the sound waves in the system travel into the attenuation branch 82 (over a distance of X/2) and are reflected back (over a distance of X/2), thus travelling a distance of (L) in total. (L−X+X/2+X/2=L) If the branch attenuator 82 is used on a section of pipe between the inlet 12 and a muffler at the outlet 18, then the length L−X should include the length of unperforated pipe that may extend into the muffler. By doing this, the pipe or second chamber 24 will have dual characteristics that are partly like a pipe or chamber equal to its length, and also like a pipe or chamber equal to length L. So if the pipe is ⅔ L with a branch that is ⅙ L, then it will act somewhat like a pipe that is ⅔ L and somewhat like a pipe that is 1 L. In the case where the catalytic converter is located in the middle of the expansion chamber, the attenuation branch should be located in the middle of section 16 or 24, between the catalytic converter 22 and the convergent cone 14 or 28.

Figure 12:
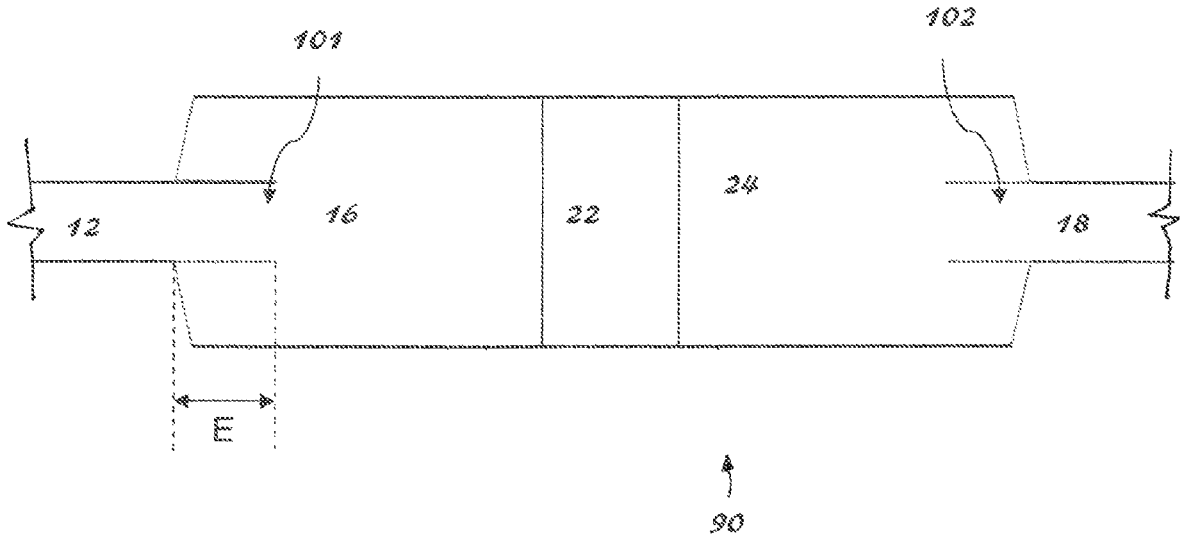
FIG. 12 is a longitudinal sectional view of an alternative example of a preferred embodiment of apparatus of the invention showing an optional internal extension attenuator.

An alternative preferred embodiment of four cycle internal combustion engine exhaust apparatus 90 is portrayed in FIG. 12. As shown, the inlet pipe 12 may be extended into the first chamber 16, as indicated at 101. This extension 101 may be calibrated to facilitate sound attenuation and/or power gains consistent with the description above. Similarly, the outlet pipe 18 may include an extension 102 into the second chamber 24, which operates in a similar manner to attenuate selected frequencies and/or utilize pressure waves to increase engine output power according to the principles described elsewhere herein. It should be understood that the extensions 101, 102, in this embodiment function in a manner similar to the branch attenuator 82 (FIG. 11) described above, with the difference that the length E of the extension(s) is/are transited once by the pressure wave(s) under consideration, not twice as with the reflected pressure wave(s) encountering the attenuation branch 82.

Figure 13:
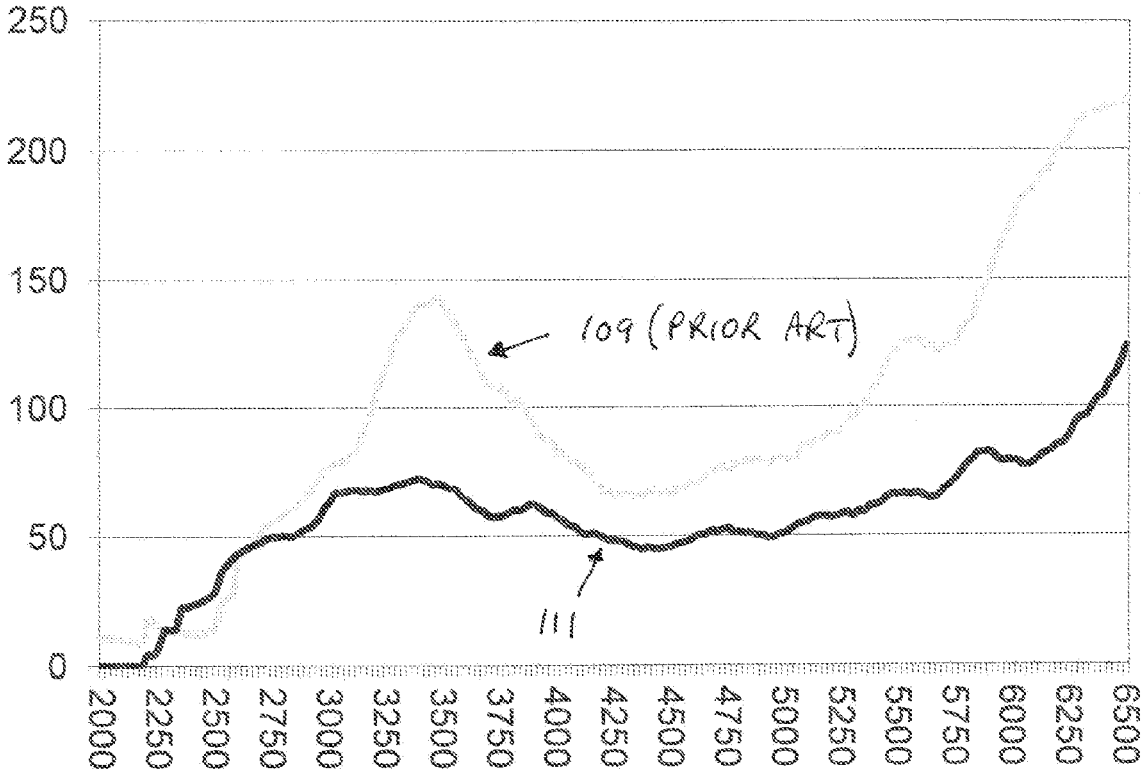
FIG. 13 is a (unitless) graph of exhaust sound level at full engine load versus engine RPM, showing the sound level of an exemplary embodiment of the exhaust apparatus of the invention compared to a prior art exhaust.
Figure 14:
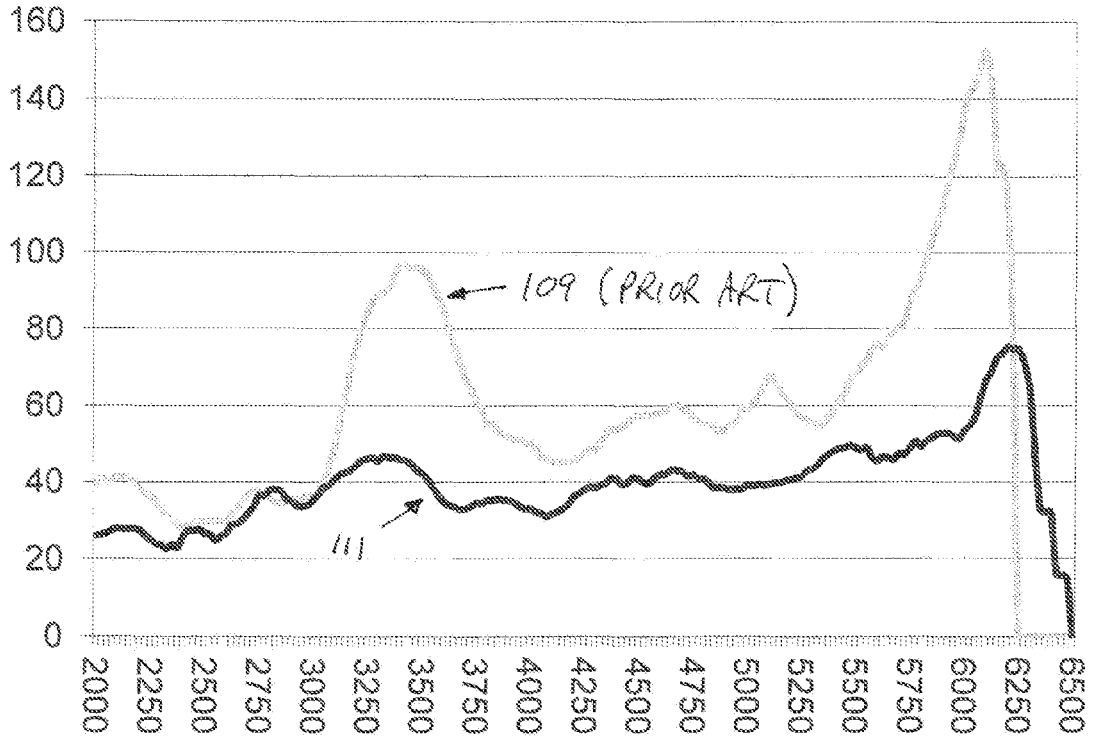
FIG. 14 is a (unitless) graph of exhaust sound level at light engine load versus engine RPM, showing the sound level of an exemplary embodiment of the exhaust apparatus of the invention compared to a prior art exhaust.

FIGS. 13 and 14 show unitless plots of the sound level from inside the passenger compartment of a 2008 Honda S2000. The exhaust systems used for the tests were similar with the exception that the conventional system used a constant diameter pipe in place of the exhaust apparatus of the invention described herein. Line 109 represents the sound level produced by the conventional system with the constant diameter pipe, and line 111 depicts the sound level produced by the exhaust apparatus of the invention. The exemplary embodiment of the invention greatly attenuated the highly undesirable resonance that occurred at 3500 RPMs, which is a common engine speed while cruising on the highway. Since the sound recordings did capture noise from additional sources (i.e., road noise), the actual reduction in exhaust noise is believed to be more significant than the graphs indicate. The recordings represented by FIG. 13 were performed with the engine at full load (wide open throttle). The measurements for the plot of FIG. 14 were obtained using an electronically controlled throttle that maintained a reduced engine load slightly above what is required for highway cruising. It should be noted that the sound attenuation described and shown may be achieved by using apparatus of the invention configured for sound attenuation, either with or without the use of a branch attenuator (e.g., 82 FIG. 11), so long as the apparatus is configured for the appropriate overall effective length as disclosed herein.

While the making and using of various exemplary embodiments of the invention are discussed herein, it should be appreciated that the present invention provides inventive concepts which can be embodied in a wide variety of specific contexts. It should be understood that the system and methods of the invention may be practiced with four cycle internal combustion engines of any conceivably practical size and implementation, including for example, 4, 5, 6, 8, 10, and 12 cylinder engines and Wankel rotary engines. For purposes of clarity, detailed descriptions of functions, components, and systems familiar to those skilled in the applicable arts are not included. The apparatus of the invention provide one or more advantages including but not limited to, enhanced performance, improved efficiency, and improved sound attenuation. While the invention has been described with reference to certain illustrative embodiments, those described herein are not intended to be construed in a limiting sense. For example, variations or combinations of features and materials in the embodiments shown and described may be used in particular cases without departure from the invention. Various modifications and combinations of the illustrative embodiments as well as other advantages and embodiments of the invention will be apparent to persons skilled in the arts upon reference to the drawings, description, and claims.

I claim:

1. Exhaust apparatus for insertion into an exhaust system of a four cycle internal combustion engine, the exhaust system having a predetermined total length, comprising:

an inlet adapted for receiving exhaust from the engine;

a divergent cone having at one end a smaller diameter opening and a larger diameter opening on an opposite end, the small diameter opening of the divergent cone being coupled and in fluid communication with the inlet;

a first chamber coupled to the larger diameter opening of the divergent cone;

a catalytic converter in fluid communication with the first chamber, downstream of the first chamber; and a second chamber in fluid communication with, and downstream of, the catalyst and coupled to an outlet through a convergent cone interposed between the second chamber and an outlet, the convergent cone having a larger opening coupled with the second chamber and a smaller diameter opening coupled with the outlet;

wherein the distance between where the smaller opening of the divergent cone and the smaller opening of the convergent cone is at least approximately one-quarter of a length of the exhaust system.

2. Exhaust apparatus for a four cycle internal combustion engine according to claim 1 further comprising a convergent cone interposed between the first chamber and the catalytic converter.

3. Exhaust apparatus for a four cycle internal combustion engine according to claim 1 further comprising sound deadening material integrated with one or more internal surface.

4. Exhaust apparatus for a four cycle internal combustion engine according to claim 1 further comprising sound deadening material integrated with one or more internal surfaces, the sound deadening material further comprising a refractory substance encased in perforated metal.

5. Exhaust apparatus for a four cycle internal combustion engine according to claim 1 further comprising anti-reversion vanes integrated with one or more internal surfaces.

6. Exhaust apparatus for a four cycle internal combustion engine according to claim 1 wherein the apparatus is configured to be approximately one quarter of the predetermined total length of the exhaust system.

7. Exhaust apparatus for a four cycle internal combustion engine according to claim 1 wherein the apparatus is configured to be approximately one half of the predetermined total length of the exhaust system.

8. Exhaust apparatus for a four cycle internal combustion engine according to claim 1 further comprising a branch attenuator having a length of about one half of the length that the total apparatus is short of a selected overall length.

9. Exhaust apparatus for a four cycle internal combustion engine according to claim 1 further comprising a plurality of branch attenuators, each having a length such that the sum of the lengths of all branch attenuators equals about one half of the length that the total apparatus is short of a selected overall length.

10. Exhaust apparatus for a four cycle internal combustion engine comprising:

an inlet in fluid communication with an associated engine for receiving exhaust from the engine;

a divergent cone having a narrow end affixed to the inlet, and also having a wide end;

a first chamber affixed to and in fluid communication with the wide end of the divergent cone;

a catalytic converter in fluid communication with, and downstream of, the wide end of the divergent cone, and in fluid communication with a second chamber affixed to a wide end of a convergent cone;

an outlet in fluid communication with a narrow end of the convergent cone; and one or more branch attenuator in fluid communication with one or more chamber or cone in a configuration adapted to attenuate the resonant frequency of the exhaust.

11. Exhaust apparatus for a four cycle internal combustion engine according to claim 10 wherein each branch attenuator has a length such that the sum of the lengths of all branch attenuators equals about one half of the length that the total apparatus is short of a selected overall length.

12. Exhaust apparatus for a four cycle internal combustion engine according to claim 10 wherein the divergent cone has an angle of divergence is within the range of about 5 degrees to about 90 degrees relative to the longitudinal axis.

13. Exhaust apparatus for a four cycle internal combustion engine according to claim 10 wherein the convergent cone has an angle of convergence is within the range of about 5 degrees to about 90 degrees relative to the longitudinal axis.

14. Exhaust apparatus for a four cycle internal combustion engine according to claim 1, wherein the inlet has length selected so that a rarefaction wave caused by an exhaust pressure wave from an opening of an exhaust valve on a cylinder of the engine entering the divergent cone returns to the cylinder before the exhaust valve completely closes when the engine is operating at a predetermined speed of 3000 and 8000 revolutions per minute, and before a reflection of the positive pressure wave on the catalytic converter returns.

15. An exhaust system for a predetermined four cycle internal combustion engine, the exhaust system comprising:

an inlet adapted for receiving exhaust from an engine;

a divergent cone having at one end a smaller diameter opening and at an opposite end a larger diameter opening, the small diameter opening of the divergent cone being coupled and in fluid communication with the inlet;

a first chamber coupled to the larger diameter opening of the divergent cone;

a catalytic converter in fluid communication with the first chamber, downstream of the first chamber; and a second chamber in fluid communication with, and downstream of, the catalyst and coupled to an outlet through a convergent cone interposed between the second chamber and an exhaust outlet, the convergent cone have a larger opening coupled with the second chamber and a smaller diameter opening coupled with the outlet;

wherein the distance between where the smaller opening of the divergent cone and the smaller opening of the convergent cone is at least approximately one-quarter of the total length between the inlet and the outlet.

16. The exhaust system of claim 15, wherein the inlet has length selected so that, when the inlet is connected to the header of the engine, a rarefaction pressure wave caused by an exhaust pressure wave from an opening of an exhaust valve on a cylinder of the engine entering the divergent cone returns to the cylinder before the exhaust valve completely closes when the engine is operating at a predetermined speed between 3000 and 8000 revolutions per minute, and before a reflection of the exhaust pressure wave off the catalytic converter returns to the cylinder.

17. The exhaust system of claim 16, wherein the rarefaction wave returns to the cylinder when an intake valve to the cylinder and the exhaust valve are each at least partially open at the predetermined engine speed between 3000 and 8000 revolutions per minute.

18. The exhaust system according to claim 16, wherein the distance between where the smaller opening of the divergent cone and the smaller opening of the convergent cone is one-half of a total length between the inlet and the outlet.

19. The exhaust system of claim 15, wherein the distance between where the smaller opening of the divergent cone and the smaller opening of the convergent cone is at least one-quarter of a total length between the inlet and the outlet.

20. The exhaust system of claim 15, wherein the distance between where the smaller opening of the divergent cone and the smaller opening of the convergent cone is between approximately one-quarter and one-half of a total length between the inlet and the outlet.

21. The exhaust system of claim 15, wherein the distance between where the smaller opening of the divergent cone and the smaller opening of the convergent cone is between one-quarter and one-half of a total length between the inlet and the outlet.

22. The exhaust system according to claim 15, wherein the catalytic converter is located a distance from the small diameter opening of the divergent cone so that a reflection of the exhaust pressure wave reaches the exhaust valve after the exhaust valve closes.

23. Apparatus comprising:

an exhaust pipe adapted for receiving exhaust from an engine;

an expansion chamber coupled to the larger diameter opening of the divergent cone;

a catalytic converter in fluid communication with the expansion chamber, downstream of the expansion chamber;

wherein the exhaust pipe has a predetermined length selected so that, when it is connected to the engine, a rarefaction pressure wave caused by an exhaust pressure wave from an opening of an exhaust valve on a cylinder of the engine entering the expansion chamber returns to the cylinder before the exhaust valve completely closes when the engine is operating at a predetermined speed between 3000 and 8000 revolutions per minute, and before a reflection of the exhaust pressure wave off the catalytic converter returns to the cylinder.

24. The apparatus according to claim 23, wherein the rarefaction pressure wave returns to the cylinder when an intake valve to the cylinder and the exhaust valve are each at least partially open at the predetermined speed of between 3000 and 8000 revolutions per minute.

25. The apparatus of claim 23, wherein the catalytic converter is located with respect to the expansion chamber so that the reflection of the exhaust pressure wave off of the catalytic converter reaches the exhaust valve after the exhaust valve closes.

26. The apparatus according to claim 23, further comprising a divergent cone defining at least part of the first chamber, the divergent cone having at one end a smaller diameter opening and at an opposite end a larger diameter opening, the small diameter opening of the divergent cone being coupled and in fluid communication with the exhaust pipe.

27. The apparatus according to 26, wherein the divergent cone has an angle of divergence within the range of about 5 degrees to about 90 degrees relative to a longitudinal axis.

28. Apparatus comprising:

a four cycle internal combustion engine with at least one cylinder having inlet valve and an exhaust valve;

an exhaust pipe adapted for receiving exhaust from an engine;

an expansion chamber coupled to the exhaust pipe;

a catalytic converter in fluid communication with the expansion chamber, downstream of the first chamber;

wherein the first chamber and the catalytic converter are located a distance from the engine such that a rarefaction wave caused by an exhaust pressure wave from an opening of an exhaust valve on a cylinder of the engine entering the expansion chamber travels to the cylinder before the exhaust valve completely closes when the engine is operating at a predetermined speed between 3000 and 8000 revolutions per minute, and before a reflection of the exhaust pressure wave off the catalytic converter returns to the cylinder.

29. The apparatus according to claim 28, wherein the rarefaction pressure wave returns to the cylinder when an intake valve to the cylinder and the exhaust valve are each at least partially open at the predetermined engine speed between 3000 and 8000 revolutions per minute.

30. The apparatus of claim 28, wherein the catalytic converter is located with respect to the expansion chamber so that the reflection of the exhaust pressure wave pressure wave off of the catalytic converter reaches the exhaust valve after the exhaust valve closes when the engine is operating at the predetermined speed between 3000 and 8000 revolutions per minute.

31. An exhaust apparatus for insertion into an exhaust system at a predetermined position within the exhaust system for a four cycle internal combustion engine, the exhaust system having a predetermined length, comprising:

a divergent cone having at one end a smaller diameter opening and a larger diameter opening on an opposite end, the small diameter opening of the divergent cone being adapted for receiving exhaust gases from the engine;

the divergent cone forming at least in part a first chamber;

a catalytic converter in fluid communication with the first chamber, downstream of the first chamber; and a second chamber, formed at least in part by a convergent cone, in fluid communication with, and downstream of, the catalyst, the convergent cone have a larger opening coupled with the second chamber and a smaller diameter opening through which exhaust gases received from the engine exit;

wherein a distance between the smaller diameter opening of the divergent cone and the small diameter opening of the convergent cone, and the distance between the small opening of the divergent cone and the catalytic converter, are selected so that, when installed into the exhaust system, a rarefaction pressure wave caused by an exhaust pressure wave from an opening of an exhaust valve on a cylinder of the engine entering the divergent cone returns to the cylinder before the exhaust valve completely closes when the engine is operating at a predetermined speed between 3000 and 8000 revolutions per minute, and before a reflection of the exhaust pressure wave on the catalytic converter returns to the cylinder.

32. The exhaust apparatus of claim 30, wherein the distance between the smaller diameter opening of the divergent cone and the catalytic converter is selected so that a reflection of the exhaust pressure wave reaches the exhaust valve after the exhaust valve closes.

33. The exhaust apparatus of claim 30, wherein the distance between where the smaller opening of the divergent cone and the smaller opening of the convergent cone is at least approximately one-quarter of a length of the exhaust system.

* * * * *